US008819890B2

(12) United States Patent
Lin

(10) Patent No.: US 8,819,890 B2
(45) Date of Patent: Sep. 2, 2014

(54) ROTATIONAL STRUCTURE

(71) Applicant: Dikai International Enterprise Co., Ltd., Taoyuan Hsien (TW)

(72) Inventor: Chang-I Lin, Taoyuan Hsien (TW)

(73) Assignee: Dikai International Enterprise Co., Ltd., Taoyuan Hsien (TW)

( * ) Notice: Subject to any disclaimer, the term of this patent is extended or adjusted under 35 U.S.C. 154(b) by 0 days.

(21) Appl. No.: 13/837,201

(22) Filed: Mar. 15, 2013

(65) Prior Publication Data

US 2014/0201934 A1 Jul. 24, 2014

(30) Foreign Application Priority Data

Jan. 18, 2013 (TW) ..... 102201217 U

(51) Int. Cl.
*A47L 13/58* (2006.01)
*A47L 13/142* (2006.01)

(52) U.S. Cl.
CPC ..... *A47L 13/142* (2013.01)
USPC ..... 15/260; 34/58

(58) Field of Classification Search
USPC ..... 15/260, 263; 34/58
See application file for complete search history.

(56) References Cited

U.S. PATENT DOCUMENTS

| | | | | |
|---|---|---|---|---|
| 8,220,101 | B2 * | 7/2012 | Chen | 15/119.1 |
| 8,291,544 | B2 * | 10/2012 | Chen et al. | 15/260 |
| 8,336,160 | B2 * | 12/2012 | Chen | 15/260 |
| 2012/0174335 | A1 * | 7/2012 | Shao | 15/260 |

FOREIGN PATENT DOCUMENTS

| | | |
|---|---|---|
| TW | 378721 M | 4/2010 |
| TW | 424118 M | 3/2012 |

* cited by examiner

*Primary Examiner* — Randall Chin
(74) *Attorney, Agent, or Firm* — Rosenberg, Klein & Lee

(57) ABSTRACT

A rotational structure applied to a rotational mop set is provided. The rotational structure comprises a rotating body, a rotating unit, and at least a pawl unit. The rotating body has at least a stopper. The rotating unit is rotatably assembled to the rotating body, and has a through hole. A spiral bar penetrates the through hole for driving the rotating unit along a first rotating direction or a second rotating direction. The pawl unit is corresponded to the stopper and rotatably assembled to the rotating unit for engaging with the stopper when the rotating unit rotates along the first rotating direction to drive the rotating body to rotate along the first rotating direction, and the pawl unit escapes from the stopper when the rotating unit rotates along the second rotating direction.

8 Claims, 6 Drawing Sheets

ROTATIONAL STRUCTURE

FIELD OF THE INVENTION

The present invention relates to a rotational structure, and more particularly relates to a rotational structure assembled to a rotational mop, which has a pawl unit engaging with a stopper for driving the mop.

BACKGROUND OF THE INVENTION

The mop is a broadly used cleaning equipment for cleaning the floor of various occasions and has become a demanded tool for every families. For the traditional mop, the user needs to squeeze the mop with both hands to achieve the object of removing excess water on the mop cloth. However, such operation is inconvenient for the user and the effect of extracting water is limited.

To enhance convenience of environmental cleaning, the traditional mop, which is composed of a handle and a mop head mounted to the end of the handle, has gradually been replaced by the rotational mop and a respective drying bucket. However, the rotational mop still has some drawbacks to be resolved.

In the traditional rotational mop, the purpose of spin drying is achieved through the linkage of gears. For example, the mop structure disclosed in R.O.C Patent No. M424118 has a rack on the inner wall of the outer bar and a driving gear set engaged with the rack and the inner bar. The inner bar is rotated through the engagement of the first gear portion, the second gear portion, and the third gear portion of the driving gear set and the rack to drive the mop plate so as to achieve the object of spin drying.

The mop structure disclosed in R.O.C Patent No. M378721 has a main gear assembled to a stationary base, the main gear has a bar assembled thereon. An upper idle gear and a lower idle gear are engaged with the main gear. The lower idle gear is connected to a shaft. To use the mop structure is used, the bar is rotated to drive the main gear. The rotation of the main gear drives the lower idle gear to generate a horizontal rotation to have the mop plate seat and the mop plate body rotated along the same direction through the shaft. Thereby, a centrifugal force is generated to remove the water on the mop cloth so as to achieve the object of spin drying.

The above mentioned rotational mop structures achieve the object of spin dry through the usage of gears to transfer rotational power, however, the engagement between the gears might not be perfect to leave some gaps between the gears. Thus, when using the above mentioned rotational mop, the gaps between the gears may delay rotation transfer and result in a feeling of discomfort when gear teeth collide to another gear. In addition, the conditions of jump teeth or off teeth are common when using the gears to drive the mop, which may shorten the lifetime of the mop.

BRIEF SUMMARY OF INVENTION

In view of the prior art, the gaps between the gears may result in a feeling of discomfort and the problems of jump teeth or off teeth easily. Accordingly, it is a main object of the present invention to provide a rotational structure assembled to a rotational mop and features a pawl structure engaging with a stopper for driving the mop to achieve the effect of spin drying.

Accordingly to the above object, a rotational structure is provided in accordance with an embodiment of the present invention. The rotational structure is applied to a rotational mop set, which includes a rotational mop and a dryer, and the rotational structure is utilized to be assembled in the rotational mop. The rotational structure comprises a rotating body, a rotating unit, and at least a pawl unit. The rotating body has at least a stopper. The rotating unit is rotatably assembled to the rotating body, and has a through hole. A spiral bar penetrates the through hole for driving the rotating unit along a direction selected from a group consisting of a first rotating direction and a second rotating direction. The pawl unit is corresponded to the stopper and rotatably assembled to the rotating unit for engaging with the stopper when the rotating unit rotates along the first rotating direction to drive the rotating body to rotate along the first rotating direction so as to remove water in the dryer, and the pawl unit escapes from the stopper when the rotating unit rotates along the second rotating direction.

Because the rotational structure provided in accordance with the embodiment of the present invention achieves the effect of spin drying by using the spiral bar to drive the rotating unit to have the pawl unit engaging with the stopper by the generated centrifugal force so as to drive the mop to rotate, the gear set is not needed and thus the shortcomings of prior art would not exist.

In addition, according to an embodiment of the present invention, the rotating body is a cylinder with an empty interior, the stopper is assembled to an inner wall of the rotating body, and the stopper is a ratchet tooth. Moreover, the rotating unit is located in the rotating body and has at least an accommodating portion for locating the pawl unit. The accommodating portion has at least a connecting hole, and the pawl unit has a connecting portion and a pawl portion, the connecting portion is rotatably connected to the connecting hole, when the rotating unit rotates along the first rotating direction to drive the connecting portion to rotate to have the pawl portion engaging with the stopper.

In addition, according to an embodiment of the present invention, the rotational mop includes a handling bar structure, and the spiral bar is located in the handling bar structure. When the handling bar structure moves along a first moving direction, the spiral bar moves along the first moving direction to drive the rotating unit rotates along the first rotating direction. When the handling bar structure moves along a second moving direction, the spiral bar moves along the second moving direction to drive the rotating unit rotates along the second rotating direction. In addition, the through hole has a plurality of spiraling grooves corresponded to threads of the spiral bar.

In addition, according to an embodiment of the present invention, the rotational mop further includes a rotating tube, which is connected to the handling bar structure through a coupling unit, the rotating tube is connected to the rotating body such that when the rotating unit rotates along the first rotating direction to drive the rotating body rotates along the first rotating direction, the rotating body also drives the rotating tube rotates along the first rotating direction. In addition, the rotating body is located at an upper end of the rotating tube and coupled to the rotating tube, and the rotational mop further includes a mop plate connected to the rotating tube such that when the rotating tube rotates along the first rotating direction, the mop plate is driven by the rotating tube to rotate along the first rotating direction.

The embodiments adopted in the present invention would be further discussed by using the flowing paragraph and the figures for a better understanding.

DETAILED DESCRIPTION OF THE INVENTION

There are various embodiments of the rotational structure in accordance with the present invention, which are not repeated hereby. The preferred embodiment is mentioned in the following paragraph as an example. It should be understood by those skilled in the art that the preferred embodiments disclosed in the following paragraph are merely an example instead of restricting the scope of the invention itself.

Figure 1:
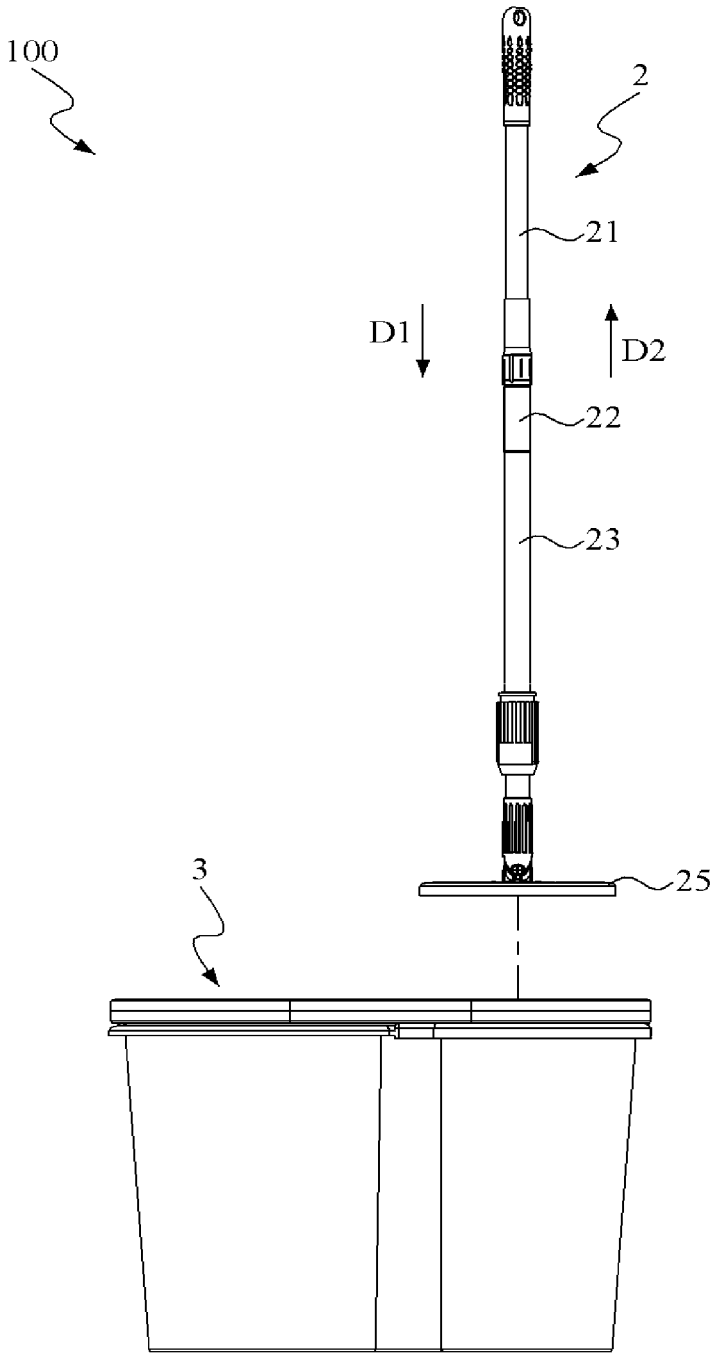
FIG. 1 is a 3D schematic view showing a rotational mop set in accordance with a preferred embodiment of the present invention.
Figure 2:
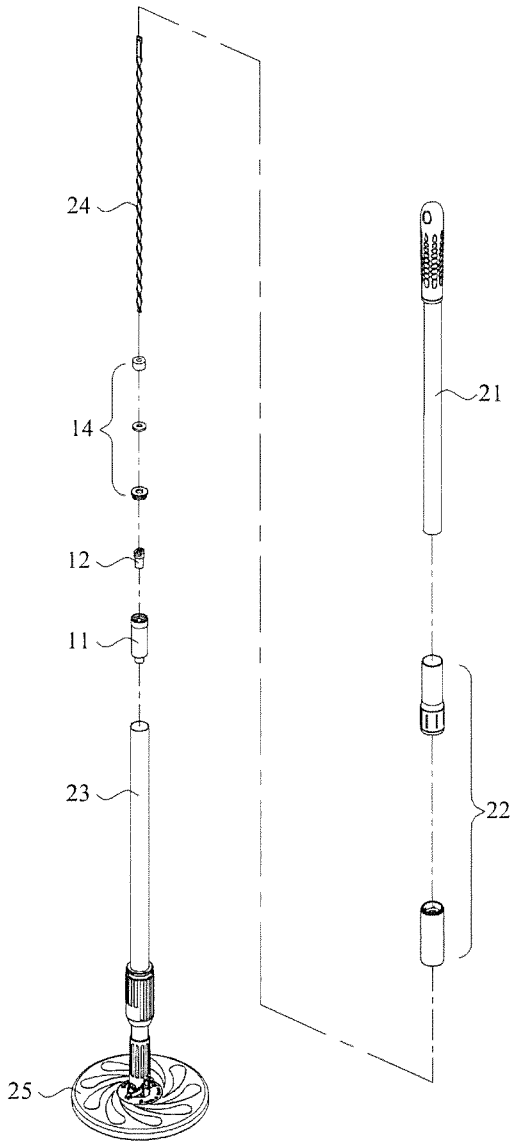
FIG. 2 is an explosive view showing a rotational mop in accordance with a preferred embodiment of the present invention.
Figure 3:
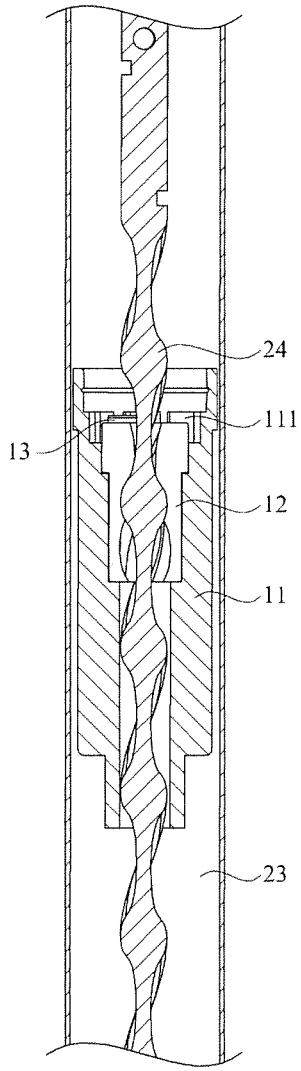
FIG. 3 is a schematic cross section view showing a rotational structure in accordance with a preferred embodiment of the present invention assembled to a rotating tube.
Figure 4:
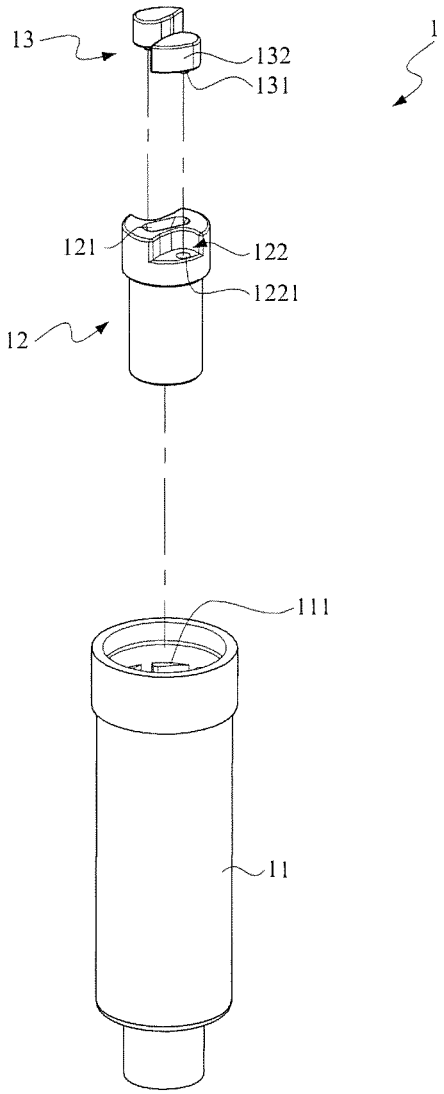
FIG. 4 is a schematic explosive view showing a rotational structure in accordance with a preferred embodiment of the present invention.

Refer to FIGS. 1 to 4, wherein FIG. 1 is a 3D schematic view showing a rotational mop set in accordance with a preferred embodiment of the present invention, FIG. 2 is an explosive view showing a rotational mop in accordance with a preferred embodiment of the present invention, FIG. 3 is a schematic cross section view showing a rotational structure in accordance with a preferred embodiment of the present invention assembled to a rotating tube, and FIG. 4 is a schematic explosive view showing a rotational structure in accordance with a preferred embodiment of the present invention.

As shown, the rotational structure provided in the present invention is applicable to a rotational mop set 100, which includes a rotational mop 2 and a dryer 3, and the rotational structure 1 is assembled in the rotational mop 2. The rotational structure 1 includes a rotating body 11, a rotating unit 12, two pawl units 13, and a cover 14.

The rotating body 11 has a plurality of stoppers 111 (only one of them is labeled). As a preferred embodiment, eight stoppers 111 may be used. However, the present invention is not so restricted. According to the need, the rotating body 11 may have only one stopper 111. Concretely speaking, the rotating body 11 is a cylinder with an empty interior, the stopper 111 is assembled to an inner wall of the upper end of the rotating body 11, and the stopper 111 is a ratchet tooth, which shows a structure with a contour gradually protruded from the inner wall of the upper end of the rotating body 11 toward the interior. That is, the thickness of the rotating body varies gradually along the circumferential direction. However, the present invention is not so restricted.

The rotating unit 12 is rotatably assembled to the rotating body 11 and has a through hole 121. In addition, the through hole 121 has a plurality of spiraling grooves 1211 on the sidewall. Concretely speaking, the rotating unit 12 is totally located in the rotating body 11. However, the present invention is not so restricted. In other embodiments, the rotating unit 12 may be partially located in the rotating body 11. The rotating unit 12 also has two accommodating portions 122 (only one of them is labeled). In the present embodiment, the accommodating portions 122 are formed at the upper end of the rotating unit 12 to simplify the fabrication process, each of the accommodating portions 122 has a connecting hole 1221, and the accommodating portion 122 is shaped as a trench. However, the present invention is not so restricted. In other embodiments, the accommodating portions 122 may be formed at the middle or the lower end of the rotating unit 12 according to the need.

Figure 5:
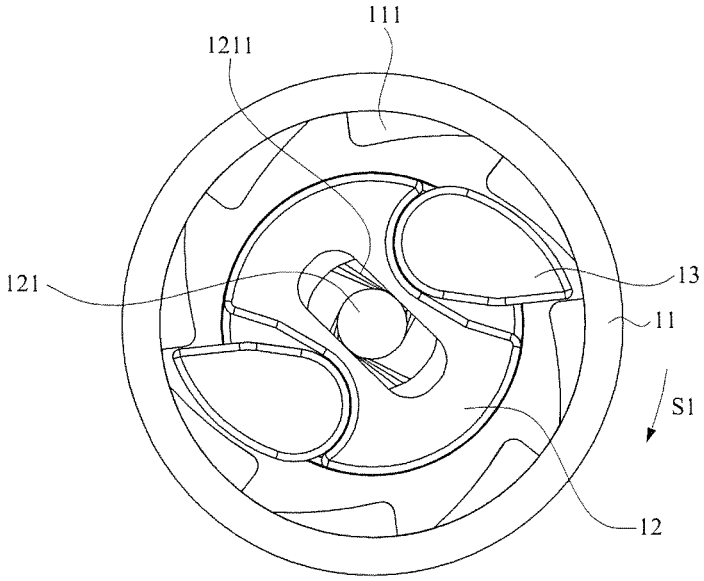
FIG. 5 is a schematic view showing a rotational structure rotating along the first rotating direction in accordance with a preferred embodiment of the present invention.

Two pawl units 13 are corresponded to the stopper 111 and rotatably connected to the rotating unit 12. Concretely speaking, in the present embodiment, the pawl unit 13 is shaped as a water drop. Referring to FIG. 5, the pawl unit 13 has a greater width near the junction to the rotating unit 12 and a smallest width at the top from the top view. In addition, the pawl unit 13 has a connecting portion 131 and a pawl portion 132, the connecting portion 131 is rotatably connected to the connecting hole 1221 to have the pawl unit 13 located in the accommodating portion 122.

It is noted that, in accordance with a preferred embodiment of the present invention, the accommodating portions 122 has a shape identical to the pawl unit 13, and the pawl unit 13 rotates centered at the connecting portion 131 to have the pawl portion 132 move toward the inner wall of the rotating body 11. In addition, the connecting portion 131 and the pawl portion 132 may be fabricated by using the material with higher stiffness to extend lifetime. The connecting means for connecting the connecting portion 131 to the connecting hole 1221 are well known to the skilled, which are not repeated here. In addition, the cover 14 is assembled on the rotating unit 12 and the pawl unit 13 to enhance structure steadiness.

The rotational mop 2 includes a handling bar structure 21, a coupling unit 22, a rotating tube 23, a spiral bar 24, and a mop plate 25. The handling bar structure 21 is utilized to be handled by the user, and it can move along a first moving direction D1 and a second moving direction D2. The coupling unit 22 is connected to the handling bar structure 21 and the rotating tube 23, and the rotating tube is connected to the rotating body 11. In addition, the rotating body 11 is located at the upper end of the rotating tube 23. However, the present invention should not be so restricted, and the rotating body may have different arrangements according to the need.

The spiral bar 24 is a screw bar for example, which is located in the handling bar structure 21 and the rotating tube 23. Concretely speaking, the spiral bar 24 is assembled in the through hole 121 and the threads of the spiral bar 24 match the spiraling grooves 1211 of the through hole 121. In addition, the spiral bar 24 is capable to move along the first moving direction D1 and the second moving direction D2. Through the engagement of the spiral bar 24 and the spiraling grooves 1211, the spiral bar 24 is able to drive the rotating unit 12 to rotate along a rotating direction selected from a first rotating direction S1 (labeled in FIG. 5) and a second rotating direction S2 (labeled in FIG. 5A). The mop plate 25 is connected to the rotating bar 23, and the dryer 3 may be a drying bucket with or without a foot pedal.

Figure 5A:
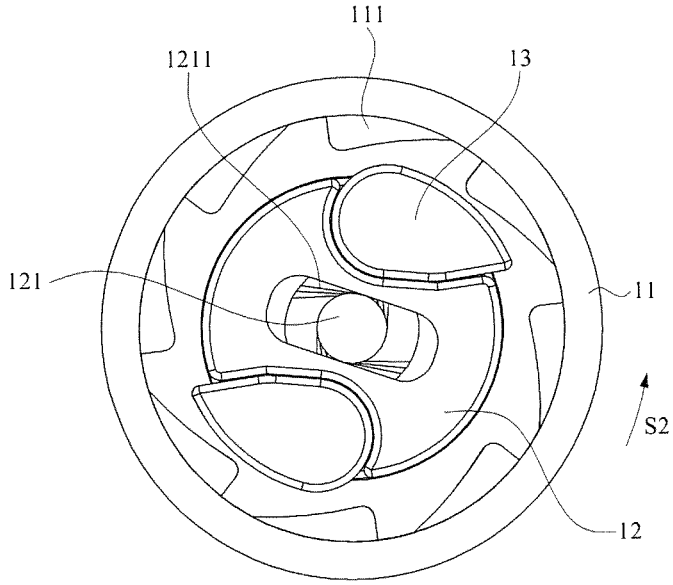
FIG. 5A is a schematic view showing a rotational structure rotating along the second rotating direction in accordance with a preferred embodiment of the present invention.

Please also refer to FIG. 1, FIG. 4, FIG. 5 and FIG. 5A, wherein FIG. 5 is a schematic view showing a rotational structure rotating along the first rotating direction in accordance with a preferred embodiment of the present invention and FIG. 5A is a schematic view showing a rotational structure rotating along the second rotating direction in accordance with a preferred embodiment of the present invention. As shown, as the user wants to dry the rotational mop, he may place the rotational mop 2 on the drying basket (not shown) of the dryer 3, then, by pushing the handling bar structure 21 to have the handling bar structure 21 move downward along the first moving direction D1, the spiral bar 24 also moves downward along the first moving direction D1 in the through hole 121 to drive the rotating unit 12 to rotate along the first rotating direction S1.

Meanwhile, as the rotating unit 12 rotates along the first rotating direction S1, the connecting portion 131 rotates with respect to the connecting hole 1221 due to the generated centrifugal force (or can be understood as the inertia effect) so as to have the pawl portion 132 moves toward the inner wall of the rotating body 11 to engage with the stopper 111 to stop the pawl unit 13. At the same time, the user keeps pushing the handling bar structure 21 downward along the first moving direction D1 to have the rotating unit 12 continuously rotate along the first rotating direction S1. Since the pawl unit 13 is engaged with the stopper 111, the rotating body 11 would be driven to rotate along the first rotating direction synchronously.

When the rotating body rotates along the first rotating direction S1, the rotating tube 23 is driven to rotate along the first rotating direction S1 synchronously and so is the mop plate 25. At this time, the drying basket of the dryer 3 is capable to remove the water on the mop plate 25 through the rotation of the mop plate 25 along the first rotating direction S1 to achieve the effect of spin drying in the dryer 3.

After pushing the handling bar structure 21 downward to the bottom, the user may pull the handling bar structure 21 upward to have the handling bar structure 21 move along the second moving direction D2. Then, the spiral bar 24 moves along the second moving direction D2 in the through hole 121 to drive the rotating unit 12 rotatably along the second rotating direction S2. At this time, the pawl unit 13 would escape from the stopper 111 and return to its original position because of the influence of the centrifugal force (or can be understood as the inertia effect). Therefore, the user may have the handling bar structure 21 move along the first moving direction D1 and the second moving direction D2 repeatedly to remove the water on the mop plate thoroughly.

In conclusion, the rotational structure 1 provided in the present invention uses the spiral bar 24 to rotate the rotating unit 12 and has the pawl unit 13 engages with the stopper 111 through the generated centrifugal force so as to drive the mop plate 25 to achieve the effect of spin drying. Thus, the gear set is not needed and the problem mentioned in the prior art would not exist.

The detail description of the aforementioned preferred embodiments is for clarifying the feature and the spirit of the present invention. The present invention should not be limited by any of the exemplary embodiments described herein, but should be defined only in accordance with the following claims and their equivalents. Specifically, those skilled in the art should appreciate that they can readily use the disclosed conception and specific embodiments as a basis for designing or modifying other structures for carrying out the same purposes of the present invention without departing from the scope of the invention as defined by the appended claims.

What is claimed is:

1. A rotational structure, applied to a rotational mop set, which includes a rotational mop and a dryer, the rotational structure being utilized to be assembled in the rotational mop, and the rotational structure comprising:

a rotating body, having at least a stopper;

a rotating unit, rotatably assembled to the rotating body, and having a through hole, a spiral bar penetrating the through hole for driving the rotating unit along a direction selected from a group consisting of a first rotating direction and a second rotating direction; and at least a pawl unit, corresponded to the stopper and rotatably assembled to the rotating unit for engaging with the stopper when the rotating unit rotates along the first rotating direction to drive the rotating body to rotate along the first rotating direction so as to remove water in the dryer, and the pawl unit escaping from the stopper when the rotating unit rotates along the second rotating direction;

wherein the rotating unit is located in the rotating body and has at least an accommodating portion for locating the pawl unit; and the accommodating portion has at least a connecting hole, and the pawl unit has a connecting portion and a pawl portion, the connecting portion is rotatably connected to the connecting hole to have the pawl portion engaging with the stopper when the rotating unit rotates along the first rotating direction to drive the connecting portion to rotate.

2. The rotational structure of claim 1, wherein the rotating body is a cylinder with an empty interior, the stopper is assembled to an inner wall of the rotating body, and the stopper is a ratchet tooth.

3. The rotational structure of claim 1, wherein the rotational mop includes a handling bar structure, and the spiral bar is located in the handling bar structure, when the handling bar structure moves along a first moving direction, the spiral bar moves along the first moving direction to drive the rotating unit rotatably along the first rotating direction.

4. The rotational structure of claim 3, wherein when the handling bar structure moves along a second moving direction, the spiral bar moves along the second moving direction to drive the rotating unit rotatably along the second rotating direction.

5. The rotational structure of claim 3, wherein the through hole has a plurality of spiraling grooves corresponded to threads of the spiral bar.

6. The rotational structure of claim 3, wherein the rotational mop further includes a rotating tube, which is connected to the handling bar structure through a coupling unit, the rotating tube is connected to the rotating body such that when the rotating unit rotates along the first rotating direction to drive the rotating body rotates along the first rotating direction, the rotating body also drives the rotating tube rotatably along the first rotating direction.

7. The rotational structure of claim 6, wherein the rotating body is located at an upper end of the rotating tube and coupled to the rotating tube.

8. The rotating structure of claim 6, wherein the rotational mop further includes a mop plate, connected to the rotating tube such that when the rotational tube rotates along the first rotating direction, the mop plate is driven by the rotating tube to rotate along the first rotating direction.

* * * * *